United States Patent [19]

Irwin et al.

[11] Patent Number: 4,688,471

[45] Date of Patent: Aug. 25, 1987

[54] AIR MOTOR HAVING INSTANT TORQUE AND LOW AIR CONSUMPTION

[75] Inventors: Everett F. Irwin, Dunedin; Irwin Walle, Clearwater, both of Fla.

[73] Assignee: Dynacycle Corporation, Dunedin, Fla.

[21] Appl. No.: 856,839

[22] Filed: Apr. 28, 1986

[51] Int. Cl.[4] ..... F01B 13/06

[52] U.S. Cl. ..... 91/482; 91/493; 91/498

[58] Field of Search ..... 91/498, 497, 493, 491, 91/482

[56] References Cited

U.S. PATENT DOCUMENTS

| | | | |
|---|---|---|---|
| 720,952 | 2/1903 | Nielsen | 91/482 |
| 1,243,494 | 10/1917 | Dunning | 91/482 |
| 2,203,646 | 6/1940 | Aspden | 91/497 X |
| 2,262,593 | 11/1941 | Thomas et al. | 91/497 X |
| 2,515,033 | 7/1950 | Connor | 91/498 X |
| 3,645,172 | 2/1972 | Koivunen | 91/493 X |
| 4,136,602 | 1/1979 | Lenz | 91/491 |
| 4,503,754 | 3/1985 | Irwin | 91/493 X |
| 4,589,328 | 5/1986 | Irwin | 91/493 X |

FOREIGN PATENT DOCUMENTS

| | | | |
|---|---|---|---|
| 5306 | of 1914 | United Kingdom | 91/491 |

*Primary Examiner*—Leonard E. Smith
*Assistant Examiner*—Paul F. Neils
*Attorney, Agent, or Firm*—Ronald E. Smith

[57] ABSTRACT

An air motor having four circumferentially spaced, radially disposed cylinders the respective radially inner ends of which slidingly engage different faces of a cube-shaped cam that is eccentrically mounted with respect to a stationary motor housing. The cam serves as a drive shaft because its eccentric mounting causes it to rotate responsive to air pressure sequentially applied to the radially inner end of pistons that are fixedly mounted in circumferentially spaced relation to a circular piston chassis positioned radially outward of the cylinders. A cylindrical bore formed in the cam is partitioned into a pressure chamber and an exhaust chamber by a shoe seal member. Four ports are formed in the cam at right angles to one another to provide fluid passageways between the pressure and exhaust chambers and slideably mounted cylinders which reciprocate with respect to their associated pistons so that rotation of the piston chassis effects valving of the motor as the cam ports sequentially and momentarily align with ports formed in the shoe seal member. The shoe seal member has three different positions and the operation of the motor depends upon which position is selected.

19 Claims, 18 Drawing Figures

AIR MOTOR HAVING INSTANT TORQUE AND LOW AIR CONSUMPTION

BACKGROUND OF THE INVENTION

1. Field of the Invention

This invention relates to improvements in air motors; more specifically, it relates to an air motor having a very small number of parts and which is characterized by a circular piston chassis or mounting ring and a unique valving means including a novel shoe seal member.

2. Description of the Prior Art

One of the present inventors holds a number of patents on fluid pressure devices, and it is believed such earlier patents represent the closest prior art to the present invention.

However, a number of breakthroughs have occured as the earlier patented devices have been improved by the present inventors.

Specifically, a means for mounting a plurality of circumferentially spaced, radially disposed pistons has been found which greatly enhances the field serviceability of the fluid pressure device which is the subject of the present disclosure.

Moreover, a unique valving means has been developed as well.

Advantageously, the new developments have reduced the number of parts required to construct the device, and have simplified its construction as well.

SUMMARY OF THE INVENTION

The present invention has a circular appearance when seen in side view, and is generally disc-shaped when seen in perspective. A stationary outer housing includes a separable left portion and a right portion so that the inner components of the motor are easily exposed for service work when the two halves of the outer housing are disconnected from one another.

A generally disc-shaped, rotatably mounted piston chassis is positioned interiorly of the outer housing, in concentric relation thereto, and is spaced apart from said outer housing so that it is free to rotate when the device is operating.

Like the outer housing, the piston chassis includes a left portion which is separably mounted to a right portion; service work is thereby easily accomplished when the separable halves of the piston chassis are disconnected from one another.

Each half of the piston chassis is provided with four equidistantly spaced slots and four slot-coincident, equidistantly spaced piston-receiving semicircular dished portions about its periphery; an annular piston mounting ring is secured to each piston and is positioned within a preselected slot so that when the left and right halves of the chassis are united, each mounting ring and hence each piston is held in its position by the united piston chassis.

Accordingly, when the piston chassis rotates as the device operates, the pistons are carried in a circular path and are held against reciprocation by the engagement of their respective mounting rings and slots.

Both the outer housing and the piston chassis are provided with aligned central openings to receive a pair of axially aligned shafts.

A first non-rotating shaft has a first, outer end with a pair of parallel, longitudinally extending bores formed therein, one of which is in fluid communication with a source of air under pressure and the other of which is an exhaust means, and a second, inner end which extends through a first central opening into the center of the air motor.

Said inner end of said non-rotating shaft is enlarged and forms said shoe seal member.

A second, rotating shaft has a first, outer end that extends outwardly of the device through the second central opening and has an enlarged, cube-shaped inner end positioned at the center of the motor.

The enlarged inner end of the rotating shaft is provided with a cylindrical bore into which is positioned the complementally formed inner end of the first, non-rotating shaft, said inner end being said shoe seal member.

A cylindrical casing houses said shoe seal member; thus, the diameter of the cylindrical bore formed in the enlarged inner end of the rotating shaft is sufficient to receive the shoe seal and its housing.

The enlarged inner end of the rotating shaft also has formed therein four fluid passageways which extend radially from the cylindrical bore to the center of the respective flat surfaces of the cam. Four cylinders, one associated with each flat surface, ride thereupon in a translatory movement attendant rotation of the cam as a result of its eccentric mounting.

The non-rotating shaft has a pair of parallel, longitudinally extending bores as aforesaid; one of the bores introduces pressurized air into the cylindrical bore formed in the enlarged end of the rotating shaft and the other bore provides an exhaust passageway so that spent air may leave said cylindrical bore.

The cylindrical bore is partitioned by a unique shoe seal member into a pressure chamber and an exhaust chamber, which chambers are in fluid communication with the pressurized air and exhausted air passageways, respectively.

The shoe seal is a cylindrical member having a number of fluid passageways formed therein; O-rings are employed to isolate particular passageways from adjoining passageways so that the valving function of the shoe seal can operate.

Moreover, the shoe seal is longitudinally displaceable so that different passageways formed therein may align and mis-align with the four passageways that interconnect the pressure and exhaust chambers of the cylindrical bore and the respective inner ends of the cylinders.

Means are also provided whereby the non-rotatable shaft may be rotated 180 degrees to change the position of the shoe seal and thus allow the motor to rotate in an opposite direction.

The invention accordingly comprises the features of construction, combination of elements and arrangement of parts that will be exemplified in the construction hereinafter set forth, and the scope of the invention will be set forth in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
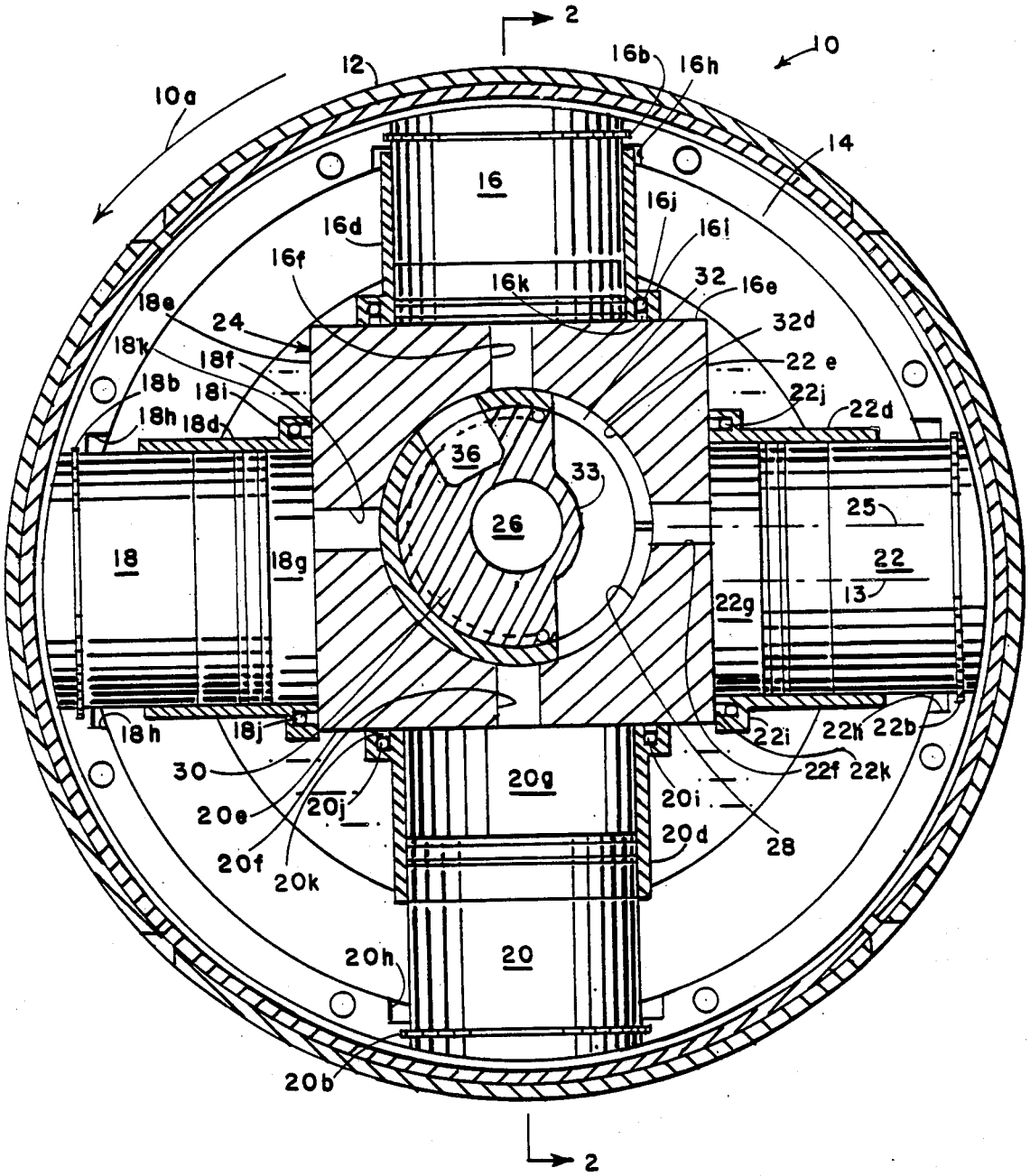
FIG. 1 is a sectional view taken along line 1—1 of FIG. 2.
Figure 14:
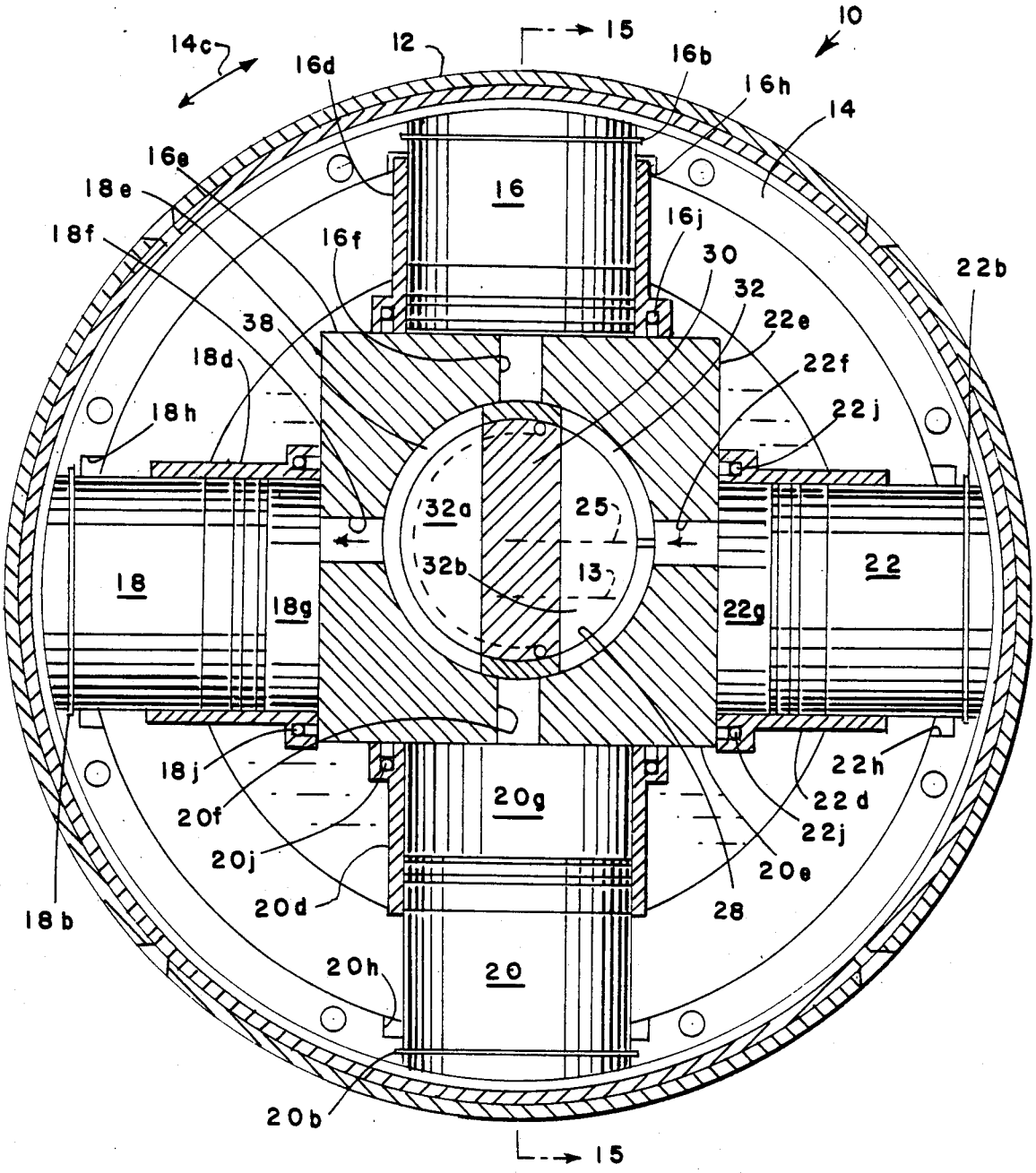
FIG. 14 is a sectional view taken along line 14—14 of FIG. 15.

Referring now to FIGS. 1 and 14, it will there be seen that the novel air motor 10 includes a circular outer housing 12 and a circular, piston-carrying inner housing 14 which will hereinafter be referred to as piston chassis 14.

The different views of FIGS. 1 and 14 show the motor 10 when its non-rotatable shaft 11 is in its "out" and "in" positions, respectively. As will be made clear as this description proceeds, the "out" position of the non-rotatable shaft 11 restricts the rotation of the piston chassis to a single direction, whereas when the non-rotatable shaft is in its "in" position, the chassis may rotate in either a clockwise or a counterclockwise direction.

Shaft 11 is rotated 180 degrees when it is in its "in" position to enable the motor to rotate in an opposite direction, as will be set forth hereinafter.

Figure 2:
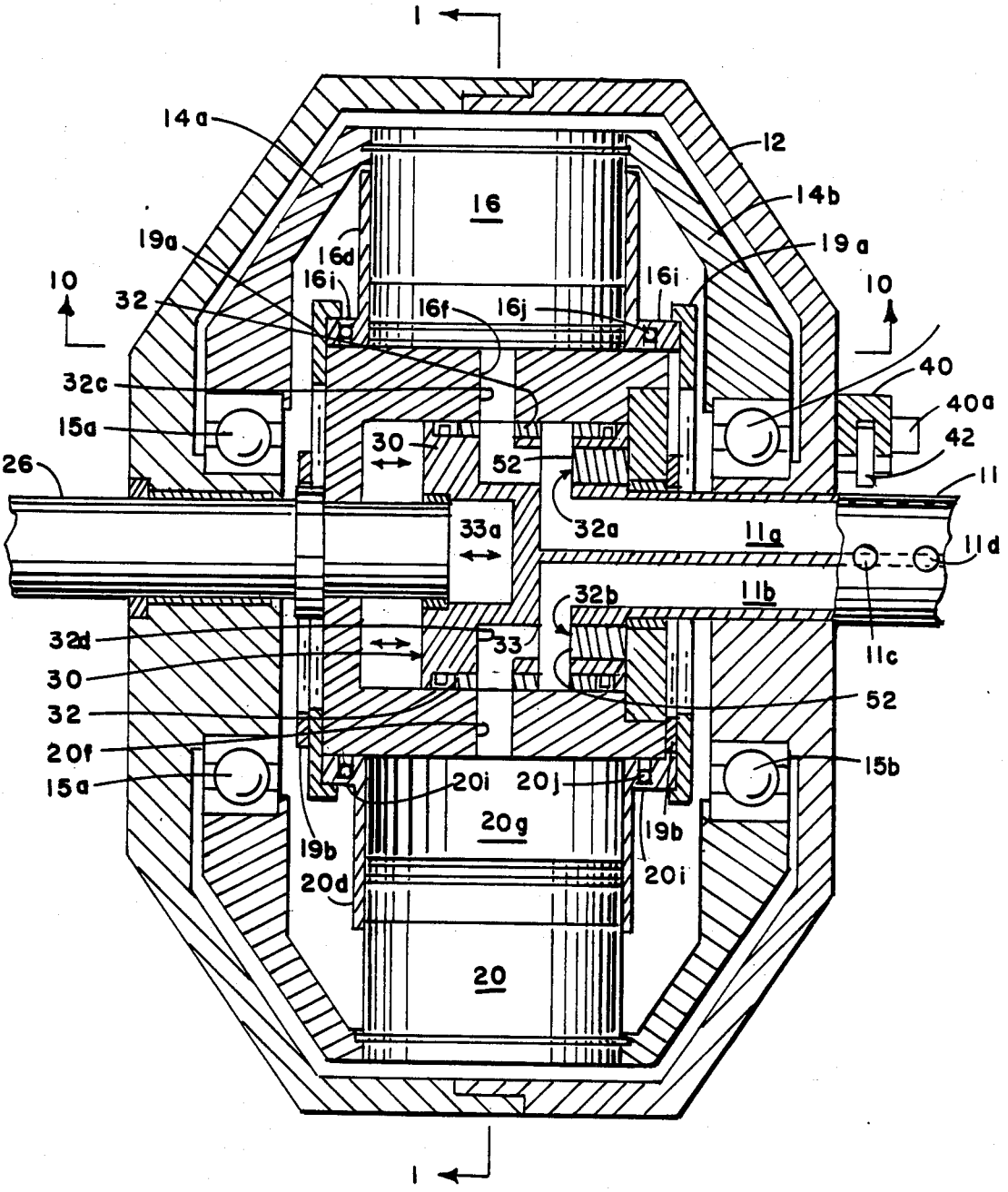
FIG. 2 is a sectional view taken along line 2—2 of FIG. 1.
Figure 15:
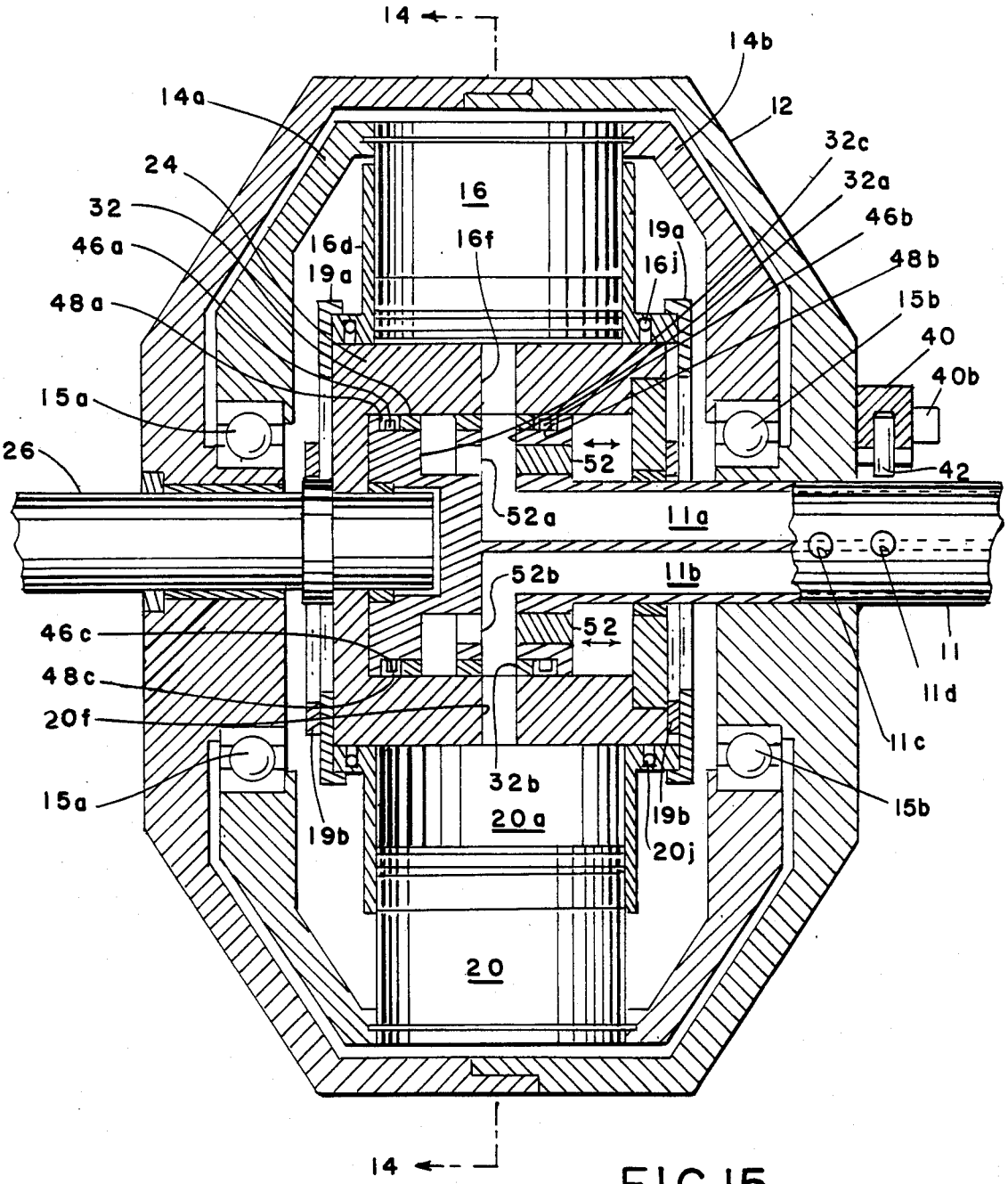
FIG. 15 is a sectional view taken along line 15—15 of FIG. 14.

Similarly, the different views of FIGS. 2 and 15 correspond to "out" and "in" positions of shaft 11, respectively.

The means for positioning non-rotatable shaft 11 into its "in" or "out" positions will be discussed hereinafter; it should be understood from the outset, however, that the invention includes a novel shoe seal member of cylindrical configuration having a port and slots formed therein which effect the valving operation of the motor; the re-positioning of shaft 11 also re-positions the shoe seal and its port and slots so that the valving means of the motor is changed when its shaft 11 is moved in or out (or rotated 180 degrees) since said seal and shaft are integrally formed.

The shoe seal member appears in the center of both FIGS. 1, 2 and 14, 15, the former pair of FIGS. disclosing the cross sectional appearance of the shoe seal when the non-rotatable shaft 11 is in its "out" position and the latter when said shaft is in its "in" position.

Piston chassis 14 is concentrically mounted with respect to housing 12 and rotates in a counterclockwise direction only as indicated by the single-headed directional arrow 10*a* appearing in FIG. 1 when the motor is operating with its non-rotating shaft 11 disposed in its "out" position as depicted in FIGS. 1 and 2 and can rotate in either direction as indicated by the double-headed directional arrow 14*c* in FIG. 14 when the non-rotating shaft 11 is in its "in" position, as aforesaid.

Annular main bearings 15*a* and 15*b* provide the rotatable mount for the chassis 14 with respect to housing 12.

Figure 9:
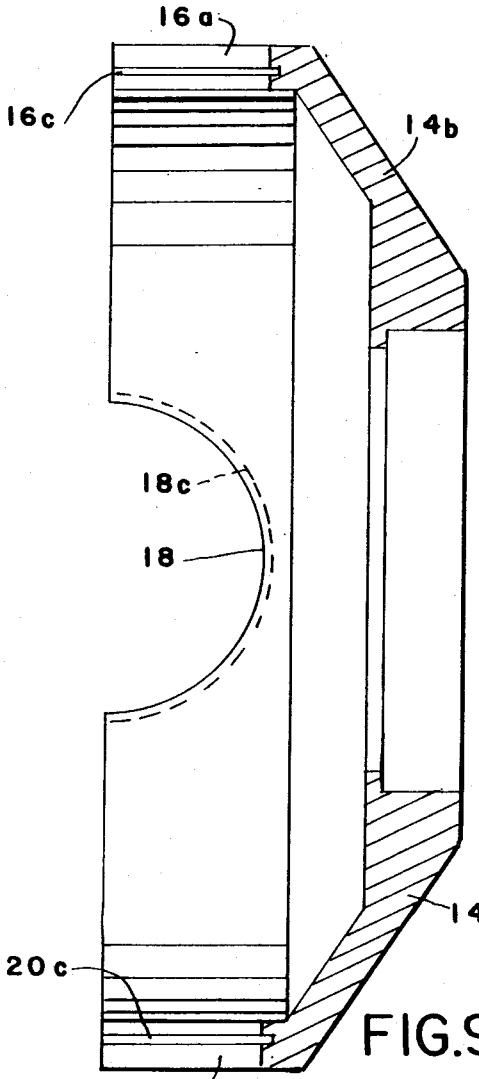
FIG. 9 is a sectional view of one part of the piston chassis.

Chassis 14 has two halves, 14*a* and 14*b* as shown in FIGS. 2 and 15; the halves are independently formed and abut one another about their respective peripheries except at the four equidistantly and circumferentially spaced locations thereabout where piston members 16, 18, 20 and 22 are mounted, there being a semicircular, piston-receiving dished region 16*a*, 18*a*, 20*a*, 22*a* (FIG. 9) at each piston location.

As shown in FIGS. 1 and 14, the four piston members 16, 18, 20 and 22 are fixedly secured to chassis 14 by mounting ring members 16*b*, 18*b*, 20*b* and 22*b* which ring members in turn are positioned in complementally formed slots 16*c*, 18*c*, 20*c*, 22*c* (FIG. 9); each slot is positioned in registration with a piston-receiving dished region 16*a*, 18*a*, 20*a*, 22*a*.

A cut out portion 16*h*, 18*h*, 20*h*, 22*h* is formed in the inner perimeter of chassis 14 at each piston location as depicted in FIGS. 1 and 14 to accommodate the cylinders when they reach their respective bottom dead center positions which position is shown for cylinder 16*d* in FIGS. 1 and 14.

When motor 10 is assembled, one of the half portions of chassis 14 is laid down with its slots 16*c*, 18*c*, 20*c*, 22*c* and piston-receiving dished regions 16*a*, 18*a*, 20*a*, 22*a* facing upwardly; a piston with its mounting ring secured thereto is then placed into its associated semicircular piston-receiving recess formed in the annular wall of chassis 14 so that the mounting ring fits into its slot. The three remaining pistons are positioned into their respective semicircular regions as well in the same manner and the other half of chassis 14 is placed in capping relation to the first mentioned half.

The second half of chassis 14 is also provided with four equidistantly spaced, piston-receiving semicircular recesses 16*a*, 18*a*, 20*a*, 22*a* about its periphery as well and the same number of mounting ring-receiving slots 16*c*, 18*c*, 20*c*, 22*c*. Accordingly, when the second half of chassis 14 is placed in capping relation to the first half, each of the four pistons is enclosed at its radially outer end by the chassis halves 14*a* and 14*b* and the mounting rings cannot disengage from their respective slots.

Thus, as chassis 14 rotates when the motor is operating, the four pistons are carried in a circular path of travel by the chassis due to the interconnection of the mounting rings to the pistons and the engagement of the mounting rings by the slots.

It should therefore be clear that service work is easily performed on motor 10 as its inner parts are so readily accessible.

The radially inner end of each piston is telescopically and slideably received within a cylinder 16*d*, 18*d*, 20*d*, and 22*d*. Each cylinder rides on a flat surface 16*e*, 18*e*, 20*e*, 22*e* formed by a cubical member 24 that is shown in FIGS. 1 and 2, 14 and 15.

Figure 11A:
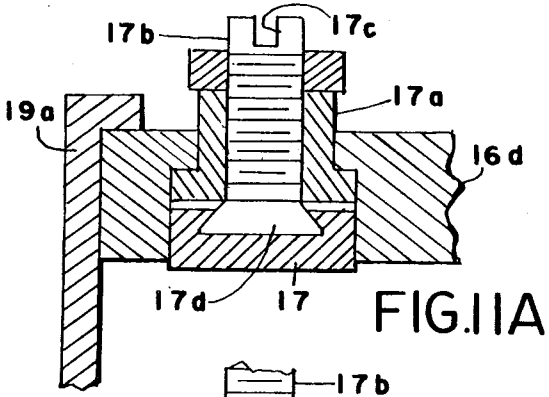
FIG. 11A is a sectional view taken along line 11A—11A of FIG. 10.
Figure 11B:
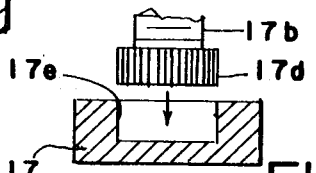
FIG. 11B is a sectional view similar to that of FIG. 11A but showing an alternative embodiment of the adjustable Teflon pads.
Figure 10:
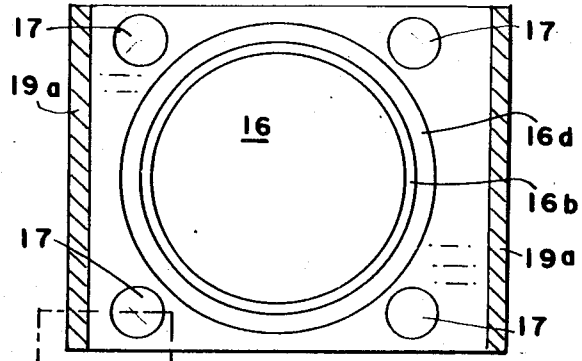
FIG. 10 is a sectional view taken substantially along line 10—10 of FIG. 2.

Glass-filled nylon buttons, shown in FIGS. 10, 11A and 11B and collectively designated 17, project outwardly from the base of each cylinder 16*d*, 18*d*, 20*d*, 22*d* and reduce the friction of the translatory movement of the cylinders with respect to their respective flat surfaces 16*e*, 18*e*, 20*e*, 22*e*. An inspection of FIGS. 1 and 14 show the translatory movement, which movement results from the eccentric mounting of member 24 with respect to the axis of symmetry of housing 12.

The friction-reducing buttons 17 were shown in an earlier patent to one of the present inventors (Irwin), but the present invention includes means for adjusting the position of said buttons.

Specifically, as shown in FIG. 11A, a boss member 17*a* is threaded and receives a screw member 17*b* having a screw driver-receiving slot 17*c*; head 17*d* of screw 17*c* is embedded in button 17 as shown. Thus, insertion of a screw driver blade into slot 17*c* and subsequent rotation of screw 17*b* will effect axial displacement of button 17 since said button is slideably mounted as depicted.

Alternatively, as shown in FIG. 11B, head 17*d* of screw 17*b* could be toothed (serrated) as shown and mounted for conjoint rotation with button 17 having serrated bore 17*e*.

Either arrangement allows a good fit to be established between buttons 17 and the respective flat surfaces 16*e*, 18*e*, 20*e*, 22*e* of cam 24 at the time motor 10 is built. Moreover, when buttons 17 become worn, screws 17*b* can be advanced to cause buttons 17 to protrude further out of the base of the cylinders in order to re-establish a good fit therebetween.

Diametrically opposed cylinders (16*d*, 20*d* and 18*d*, 22*d*) are yoked together for in unison movement by interleaved bridle rings 19*a* and 19*b*, respectively, as perhaps best shown in FIGS. 2 and 15. Thus, adjustable buttons 17 need be provided only on one member of each pair of opposed cylinders, although of course non-adjustable buttons would still be provided opposite the adjustable ones. For example, if cylinder 16*d* is provided with adjustable buttons, then there is no need to provide adjustable buttons on the base of cylinder 20*d*.

Bridle rings 19*a* (of which there are two) and 19*b* (of which there are two) have inwardly directed shoulders that engage an annular enlargement formed at the base of each cylinder as depicted in FIGS. 2 and 15, said enlargements being denoted 16*i*, 18*i*, 20*i* and 22*i*.

An annular groove (FIGS. 1 and 14) is formed in the enlarged base portion of each cylinder and an O-ring 16*j*, 18*j*, 20*j*, 22*j* is positioned therewithin. A flat, resilient, square seal member 16*k*, 18*k*, 20*k*, 22*k* overlies each grooves and each seal is biased into sealing relationship with the respective flat surfaces of cubical member 24 by the O-ring underlying it so that air does not leak from the base of the respective cylinders.

Cubical member 24 is the innermost end of drive shaft 26 and is simply an enlargement thereof. A cylindrical, axial bore 28 is formed therein as perhaps best understood by comparing FIGS. 1, 2 and 14, 15, and the inner end of non-rotating shaft 11 is received within said bore as illustrated.

As the motor operates, cubical member 24 rotates about its axis 25 which is shown in FIG. 1; since the inner ends of cylinders 16*d*, 18*d*, 20*d* and 22*d* ride upon their associated flat surfaces of the member 24 as aforesaid (it being understood that buttons 17 provide the only actual physical contact between the cylinders and the different flat surfaces), member 24 will hereinafter be referred to as a cam.

Axis 25 of cam 24 is offset with respect to the axis 13 of housing 12 and piston chassis 14 (FIGS. 1 and 14); such eccentric mounting enables the operation of the device and the amount of the offset determines the length of the piston stroke, although it should be understood that in this novel arrangement of parts it is actually the cylinders that reciprocate with respect to the non-reciprocating pistons.

Four equidistantly spaced, radially extending fluid passageways or bores are formed in cam 24 and are designated 16*f*, 18*f*, 20*f*, and 22*f*; these passageways provide fluid communication between the cylindrical bore 28 formed in cam 24 and the outer flat surfaces 16*e*, 18*e*, 20*e*, and 22*e* of cam 24.

Shoe seal 30 is encased within casing 32 and both are non-rotatably mounted within cylindrical bore 28; they provide the valving function of motor 10 in a manner that will be made clear as this description proceeds. Essentially, a port and slots formed in said shoe seal member and its casing (the port and slots formed in the seal being coincident with the port and slots formed in its casing) deliver pressurized air or provide a discharge for expended air through passageways 16*f*, 18*f*, 20*f* and 22*f* as the cylinders sequentially rotate past said stationary port and slots.

The operation of the shoe seal 30 is perhaps best understood in connection with FIGS. 1 and 14, but its physical structure is perhaps best understood in connection with FIGS. 3–8, to which FIGS. attention is now directed.

Figure 4:
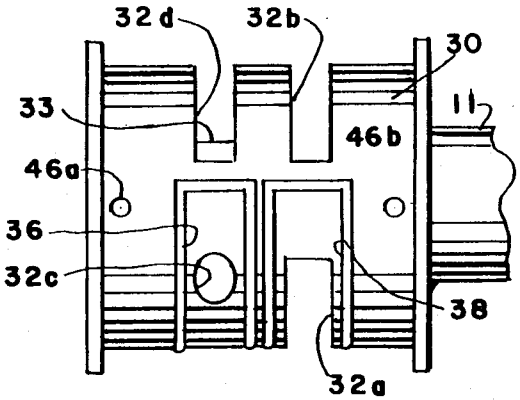
FIG. 4 is a plan view of the shoe seal.
Figure 3:
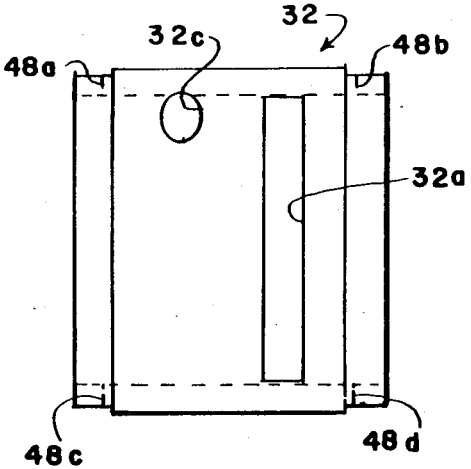
FIG. 3 is a side elevational view of the novel shoe seal casing.

FIG. 3 shows the shoe seal casing 32 in side elevation; it includes elongate slots 32*a*, formed on a first side thereof, and 32*b*, formed on the opposite side thereof (see FIG. 4; the slots and port formed on shoe seal 30 correspond to the same on casing 32. Accordingly, they will be assigned the same reference numerals).

Figure 8:
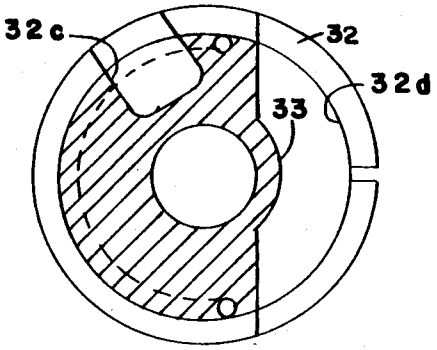
FIG. 8 is a sectional view taken along line 8—8 of FIG. 5 with the shoe seal casing added to the view as in FIGS. 6A, 6B, 7A and 7B.

Casing 32 also includes port 32*c* and elongate slot 32*d* (see FIGS. 4 and 8).

Neither casing 32 nor seal 30 rotates when motor 10 operates; cam 24 rotates with respect to the stationary shoe 30 and casing 32, however, and it is the relative rotation between the cam 24 and its fluid passageways 16*f*, 18*f*, 20*f*, 22*f* and the stationary elongate slots and port of casing 32 and the shoe seal 30 that effects the valving of motor 10.

Figure 5:
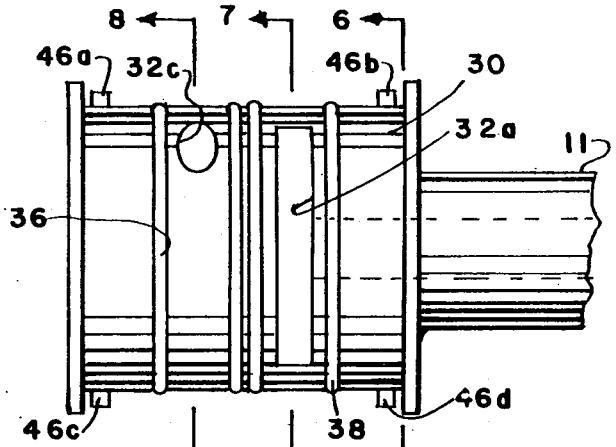
FIG. 5 is a side elevational view of the shoe seal shown in FIG. 4.

FIGS. 4 and 5 show a pair of laterally spaced O-rings 36, 38; O-ring 36 isolates port 32*c* formed in shoe seal 30 whereas O-ring 38 isolates slot 32*a* formed therein.

As shown in FIG. 5, which is a plan view of FIG. 4, shoe seal 30 is a cylindrical member and O-rings 36 and 38 extend from slightly beyond the top ridge of the seal. FIG. 7 completes the depiction of the position of the O-rings 36 and 38, showing that they extend from slightly beyond the top ridge of seal 30 to slightly beyond the bottom ridge thereof.

FIG. 2 shows pressurized air port 32*c* and exhaust slot 32*d* aligned with passageways 16*f* and 20*f*, respectively, and shows slots 32*a* and 32*b* misaligned with said passageways because shaft 11 is in its "out" position; FIG. 15 shows port 32*c* and slot 32*d* misaligned with passageways 16*f* and 20*f* and slots 32*a* and 32*b* aligned therewith because shaft 11 is in its "in" position in said FIG. Projection 33 which defines shaft-receiving bore 33*a* is formed centrally of seal 30 as shown in FIGS. 1, 2, 4, 8, and 15. Shoe 30 is metallic but its casing 32 is formed of a pliable glass-filled Teflon or nifon Pressurized air travels through port 32*c* to impinge upon the radially inner ends of the cylinders in a sequential manner attendant motor operation when shaft 11 is "out" and travels through slot 32*a* when shaft 11 is "in."

Expended air is exhausted from motor 10 through slot 32*d* when shaft 11 is "in" and is exhausted through slot 32*b* when shaft 11 is "out."

In FIGS. 1 and 14, reference numeral 11*a* indicates the pressurized air bore formed in shaft 11, and 11*b* indicates the exhaust air bore formed in said shaft.

As suggested in FIG. 1, a cylinder passing port 32*c* will receive an intake of pressurized air only briefly due to the small size of said port. However, as shown in FIGS. 7A, 7B and 14, a cylinder rotating past slot 32*a* will receive pressurized air for almost one hundred eighty degrees of its circular path of travel.

Figure 7A:
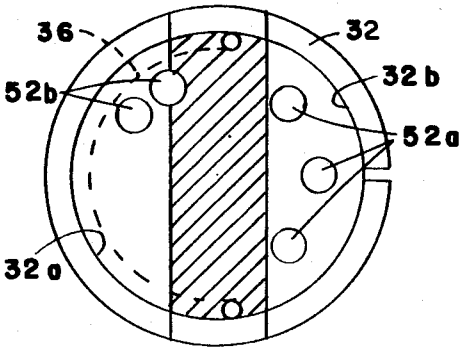
FIG. 7A is a sectional view of the shoe seal and its casing taken along line 7—7 of FIG. 5.
Figure 7B:
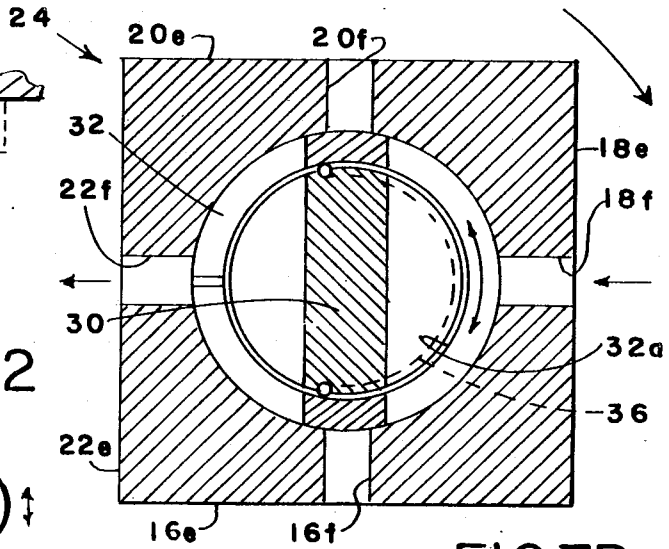
FIG. 7B is a view of substantially the same parts shown in FIG. 7A, but depicting the same when the novel motor is rotating in a direction opposite to that of FIG. 7A.

However, the exhaust cycle is substantially the same for both shaft positions; as shown in FIGS. 2 and 8 for the shaft "out" position and FIGS. 7A, 7B and 14 for the shaft "in" position, a cylinder passing slot 32*d* or 32*b*, respectively, will be open for almost one hundred eighty degrees of its path of travel.

In the position of motor 10 depicted in FIG. 1, (non-rotatable shaft 11 "out"), piston 16 is traveling counterclockwise and, accordingly, substantially all of the air radially inwardly of cylinder 16*d* has been expelled therefrom. Piston 16 is fully received within cylinder 16*d* and as a result thereof passageway 16*f* is closed at its radially outer end by the radially inner end of cylinder 16*d* as shown; moreover, passageway 16*f* is closed at its radially inner end as well by shoe seal casing 32. This position is the bottom dead center position of each cylinder as the engine operates. Cylinder 16*d* has just completed its exhaust cycle as indicated by the close proximity of passageway 16*f* to slot 32*d*.

The presence of O-ring 36 accomplishes the isolation of port 32*c* so that pressurized air does not escape into the region of exhaust slot 32*d* as is shown in FIG. 1. However, it also provides an annular space 50 (FIGS. 6A, 6B) between shoe seal 30 and its casing 32. Thus, a thin layer of pressurized air from port 32*c* is actually distributed to all points within the confines of O-ring 36.

Still making reference to FIG. 1, piston 18 and passageway 18*f* have just rotated past pressurized air port 32*c* and accordingly chamber 18*g* is expanding in volume, thereby imparting rotation to cam 24 due to its eccentric mounting. Shoe seal casing 32 in this position of piston 18 is sealing the inner end of passageway 18*f*, so no additional air under pressure is entering chamber 18*g* but the pressurized air introduced into chamber 18*g* through port 32*c* is still expanding.

Cylinder 20*d* is fully retracted with respect to piston 20 and thus passageway 20*f* is open at its radially outer end but it is closed at its radial inner end by shoe seal casing 32 and thus no air is entering or exiting chamber 20*g*. The position of cylinder 20*d* depicted in FIG. 1 is its top dead center position. The exhaust stroke of piston 20 is about to begin as indicated by the proximity of passageway 20*f* to exhaust slot 32*d*.

Finally, piston 22 is depicted in FIG. 1 half way between its top dead center and bottom dead center positions, i.e., it is depicted at the mid-point of its radially inwardly directed exhaust stroke. Thus passageway 22*f* is in fluid communication with exhaust slot 32*d*.

Figure 12:
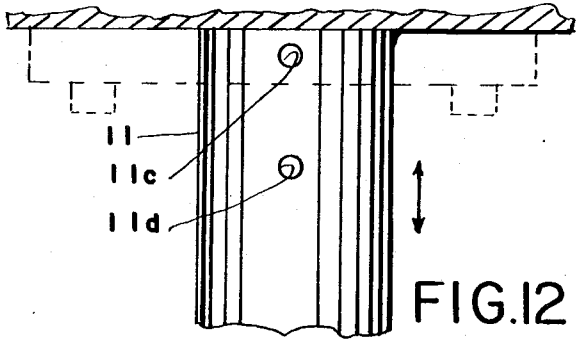
FIG. 12 is a plan view of the non-rotating shaft showing longitudinally spaced dowel pin-receiving bores formed therein.
Figure 13:
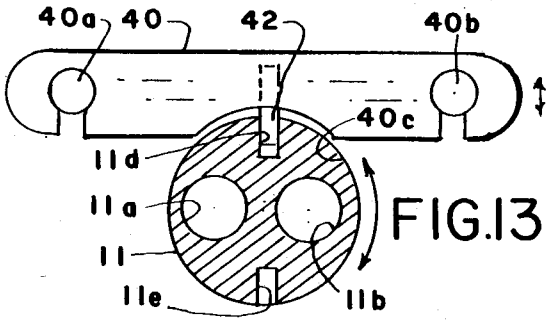
FIG. 13 is an end view of the non-rotating shaft and a dowel pin mounting assembly.

The "in" position of the non-rotatable shaft is depicted in FIG. 15, and the means for accomplishing the change in position of said shaft is depicted in FIGS. 12 and 13.

A pair of longitudinally spaced dowel pin-receiving bores are formed on the upper ridge of shaft 11, and are designated by the numerals 11*c*, 11*d* in FIG. 12. One bore only, 11*e*, is formed in the lower ridge of shaft 11, and its position is diametrically opposed to bore 11*d* since when shaft 11 is rotated 180 degrees so that the motor can rotate in an opposite direction, said shaft must be placed in its "in" position.

An elongate flat mounting strip 40 (FIGS. 2, 12, 13, 15) is detachably secured to housing 12 by a pair of thumb screws 40*a*, 40*b*. Strip 40 has an arcuate cut out portion 40*c* to accommodate shaft 11. A slideably mounted, retractable dowel pin 42 is positioned mid-length of strip 40 as shown. When shaft 11 is "out," pin 42 is slideably received within bore 11*c*, and when shaft 11 is "in," pin 42 is positioned within bore 11*d*.

To accomplish the change of shaft position mentioned hereinabove, thumb screws 40*a*, 40*b* are loosened so that strip 40 and dowel pin 42 may be disengaged from shaft 11 and the bore within which pin 42 is received. Shaft 11 is then displaced along its axis to its desired position, and pin 42 is positioned in the appropriate bore and the thumb screws are again tightened.

FIG. 7B depicts shoe seal 30 when shaft 11 is "in" and rotated one hundred eighty degrees from its position depicted in all other FIGS. Slot 32*a* and O-ring 36 are opposed to their FIG. 7A position so shaft 11 will rotate in the opposite direction as indicated by the unnumbered directional arrow appearing in said FIG. 7B, but in all other respects motor operation is unchanged.

Casing 32 tends to rotate in the direction of cam 24 rotation and therefor a means is needed to substantially prevent such rotation since if it is left unchecked then a jamming can occur as the O-rings 36, 38 are overly compressed.

Figure 6A:
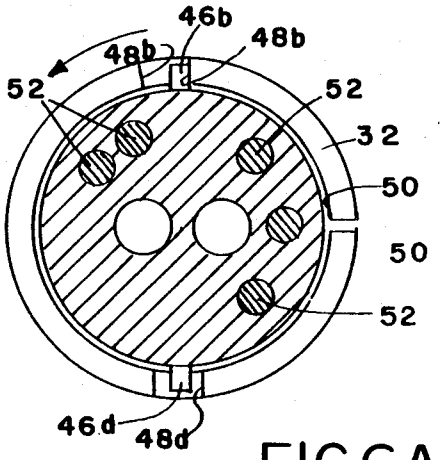
FIG. 6A is a sectional view of the shoe seal and its casing taken along line 6—6 of FIG. 5 when the motor is operating in a counterclockwise direction.
Figure 6B:
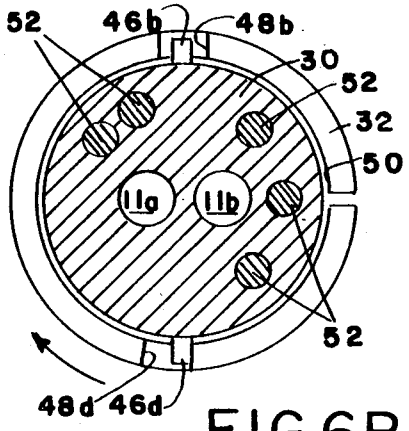
FIG. 6B is a sectional view of the shoe seal and its casing taken along line 6—6 of FIG. 5 when the motor is operating in a clockwise direction.

FIGS. 6A and 6B show how undue rotation is avoided. Pegs 46*a*, 46*b*, 46*c* and 46*d* are formed on seal 32 as shown in FIGS. 4, 5, 6A and 6B. Corresponding slots 48*a*, 48*b*, 48*c* and 48*d* are formed in casing 32 to receive said pegs as indicated in FIGS. 6A, 6B and 2, 15 as well.

When casing 32 attempts to rotate in a counterclockwise direction as depicted in FIG. 6A, stationary pegs 46*a* and 46*b* will abuttingly engage slots 48*a* and 48*b* as depicted and thus prevent further rotation.

Similarly, when casing 32 attempts to rotate in a clockwise direction as depicted in FIG, 6B, the abutting engagement of pegs 46*c* and 46*d* with slots 48*c* and 48*d* will prevent further rotation.

Thus, the angular width of slots 48*a*, 48*b*, 48*c* and 48*d* determines the maximum amount of rotation that is permissible. Some rotation is desired to allow O-rings 36, 38 to firmly set. The small annular space 50 indicated in FIGS. 6A and 6B and mentioned hereinabove represents the spacing between casing 32 and seal 30, said spacing being determined by the thickness of the O-rings and the amount they are compressed attendant rotation of casing 32 with respect to seal 30.

The plugs, collectively designated 52, appearing in FIGS. 2, 15, 6A and 6B are shown merely to indicate how port 32*c* and slot 32*d* are formed when motor 10 is constructed. As shown in FIGS. 2 and 15, said port and slot are bored radially outwardly of shaft 11 and the non-operative portions thereof are then plugged with said plug members 52.

Bores 52*a* and 52*b* (FIGS. 2, 7A and 15) are formed in shoe seal 30 to provide the needed fluid passageways.

Slots 48*a*, 48*b*, 48*c*, 48*d* formed in casing 32 may be located in other positions, and additional slots could be added as well. Moreover, other means to prevent unwanted casing rotation and subsequent jamming could be employed.

The specific positions and sizes of the port and slots of the seal 30 and its casing 32 can also be changed to obtain maximum motor performance in different applications.

What is claimed is:

1. A fluid pressure device suitable for operation as an air motor, comprising:

a generally disc-shaped, stationary housing member that is separable into a disc-shaped first half and a disc-shaped second half, said housing member having a central bore;

a piston chassis member of annular configuration that is separable into an annular first half and an annular second half;

means for rotatably mounting said piston chassis member with respect to said housing member;

said piston chassis member being concentrically mounted within said housing member;

a plurality of preferably four piston-receiving semicircular dished regions formed in said first and second annular halves of said piston chassis member so that when said halves are assembled each of said dished regions cooperatively define a piston-receiving bore;

means for fixedly securing a piston within each of said piston-receiving bores;

a rotatably mounted drive shaft mounted substantially centrally of said housing member and said piston chassis member but eccentric thereto;

said drive shaft having a power-delivering cylindrical outer end extending outwardly of the central bore formed within said housing member and an enlarged, cubical in configuration inner end or cubical member having four radially facing flat surfaces;

a piston-receiving cylinder member mounted for translatory movement with respect to each of said radially facing surfaces of said cubical member;

a piston member mounted for relative reciprocation within each cylinder member;

a bridle ring member for holding each of said cylinder members against their associated flat surfaces of said cubical member;

a bore means formed in said cubical member, centrally thereof;

a non-rotating shaft having a first bore formed therein in fluid communication with a source of air under pressure and a second parallel bore formed therein in fluid communication with ambient;

said non-rotating shaft having a first cylindrical end extending outwardly of said central opening formed in said housing member and having an enlarged cylindrical inner end positioned within the bore formed in said cubical member;

said enlarged inner end of said non-rotating shaft forming a shoe seal member that provides a valving function that enables operation of the motor;

a cylindrical casing member for housing said shoe seal member, said casing member also being positioned within said cubical member bore;

said casing member and shoe seal member being provided with a plurality of fluid passageways formed therein that enable operation of the motor, the fluid passageways within said shoe seal member being coincident with fluid passageways formed in said casing member;

a plurality of radially disposed bores formed in said cubical member that interconnect the respective bases of said cylinder members with the bore formed centrally of said cubical member;

said radially disposed fluid passageways sequentially and transiently aligning with openings formed in said shoe seal member and its casing attendant operation of said motor;

said shoe seal member and said casing member being mounted for axial displacement;

a pressurized air bore means formed in said shoe seal member;

an exhaust air bore means formed in said shoe seal member parallel to said pressurized air bore means;

both of said shoe seal bore means being confluent with corresponding bore means formed in said non-rotating shaft;

said pressurized air bore means having a first branch and a second branch;

said exhaust air bore means having a first branch and a second branch;

said first branch of said pressurized air bore means being in the form of a port and extending from said pressurized air bore means to the surface of said shoe seal member;

said second branch of said pressurized air bore means being in the form of an elongate slot and extending from said pressurized air bore means to the surface of said shoe seal member;

said first and second branches of said pressurized air bore means being formed on the same side of said shoe seal member and being longitudinally spaced apart;

said first branch of said exhaust air bore means being in the form of an elongate slot and extending from said exhaust air bore means to the surface of said shoe seal member;

said second branch of said exhaust air bore means being in the form of an elongate slot and extending from said exhaust air bore means to the surface of said shoe seal member;

said first and second branches of said exhaust air bore means being formed on the same side of said shoe seal member and being longitudinally spaced apart but being formed on the opposite side of said shoe seal member in relation to said first and second branches of said pressurized air bore means.

2. The device of claim 1, wherein said shoe seal member casing member has formed therein a port and a plurality of slots coincident with the port and slots formed in said shoe seal member so that when said shoe seal member is positioned within said casing member, the port and slots of said shoe seal member and of said casing member form fluid passageways that extend from said pressurized air bore means of said exhaust air bore means to the surface of said casing member.

3. The device of claim 2, further comprising means for longitudinally displacing said shoe seal member and casing member to provide a first or outward position for said shoe seal member and said casing member and a second or inward position for said members, whereby said first position aligns the first branch of said pressurized air bore means with one of said radially disposed bores formed in said cubical member and aligns the first branch of said exhaust air bore means with a radially disposed bore means formed in said cubical member that is diametrically opposed to said first mentioned radially disposed bore means, and whereby said second position aligns the second branch of said pressurized air bore means with one of said radially disposed bore means and simultaneously aligns the second branch of said exhaust air bore means with one of said diametrically opposed radially disposed bore means.

4. The device of claim 3, wherein said means for displacing said shoe seal member and said casing member include a pair of logitudinally spaced attachment means formed on said non-rotating shaft and a detachably mounted attachment member mounted on said housing member which is adapted to releasably engage different ones of said attachment means.

5. The device of claim 4, further comprising a pair of O-ring members, said O-ring members positioned in sealing relation about the periphery of said first and second branches of said pressurized air bore means, respectively, to isolate said pressurized air port and said pressurized air slot respectively, said O-rings being elongate and extending from the upper ridge of said shoe seal member to the lower ridge thereof.

6. The device of claim 5, wherein said O-ring members have a predetermined thickness sufficient to hold said casing member in spaced apart relation to said shoe seal member, thereby creating a cylindrical space therebetween along the respective extents thereof.

7. The device of claim 6, further comprising anti-rotation means for preventing relative rotation between said casing member and said cylindrical bore formed in said cubical member.

8. The device of claim 7, wherein said anti-rotation means includes a plurality of slots formed in said casing member, a plurality of upstanding peg members extending from the outer surface of said shoe seal member, said peg members being positioned within said slots and said slots having an angular length sufficient to allow a small amount of relative rotation between said casing member and said cylindrical bore of said cubical member to help set the seal created by said O-ring members.

9. The device of claim 8, further comprising means for reducing friction between the base of said cylinders and the surfaces of said cubical member attendant operation of the device and the concomitant translatory movement of said cylinders with respect to said flat surfaces.

10. The device of claim 9, wherein said friction reducing means is provided in the form of button members formed of a suitable friction-reducing material, which button members project upwardly from the surfaces of the respective cylinder bases within which they are mounted and which button members are provided with adjustment means to vary the height of their respective projections relative to said cylinder bases.

11. The device of claim 10, wherein the bases of the respective cylinder members are enlarged with respect to the cylinder bodies and wherein bridle ring members are provided which engage said enlarged bases of diametricaly opposed cylinder members so that cylinder members reciprocate with respect to their associated piston members in unison.

12. The device of claim 11, wherein anti-leakage means are provided to prevent air from leaking out from under the respective cylinder bases.

13. The device of claim 12, wherein said anti-leakage means includes an annular groove formed about the base of each cylinder member in its enlarged base portion, an O-ring positioned within said groove, a square in configuration seal member positioned in overlying relation to said groove, said square seal member being biased by said O-ring in said groove into tight fitting engagement with the flat surface of said cubical member with which said cylinder member is associated.

14. The device of claim 13, wherein a plurality of equidistantly and circumferentially spaced cut out portions are formed in said piston chassis member to accommodate said cylinder members as they sequentially achieve their bottom dead center positions attendant device operation.

15. The device of claim 14, wherein said means for fixedly securing said piston members to their respective piston-receiving bores includes a piston ring secured to the outer periphery of each piston member and projecting therefrom, and a piston ring-receiving slot formed coincident with said respective piston-receiving dished regions of semicircular configuration formed in said piston chassis member so that when said piston chassis member is assembled, said slots engage said rings.

16. The device of claim 15, wherein said shoe seal member is of metallic composition and wherein said casing member is of glass-filled nylon composition.

17. The device of claim 16, wherein said shoe seal member has a drive shaft-receiving bore that accomodates said drive shaft when said non-rotating shaft is in its inward position.

18. The device of claim 17, wherein means are provided to allow said non-rotating shaft to be inverted one hundred eighty degrees when said drive shaft is in its inward position so that said device can rotate in a clockwise or a counterclockwise direction.

19. The device of claim 18, wherein each of the radially disposed bore means formed in said cubical member extends from the center of the respective radically facing flat surfaces of said cubical member to the cylindrical bore formed in said cubical member and the respective axes of symmetry of said bore means is normal to their associated flat surfaces.

* * * * *